US005255739A

United States Patent [19]

Neuroth et al.

[11] Patent Number: 5,255,739

[45] Date of Patent: Oct. 26, 1993

[54] CLAMP FOR ATTACHING ELECTRIC SUBMERSIBLE PUMP CABLE TO SUCKER ROD

[75] Inventors: David H. Neuroth, Tulsa; Robert F. Bailey, Claremore, both of Okla.

[73] Assignee: Hubbell Incorporated, Orange, Conn.

[21] Appl. No.: 987,620

[22] Filed: Dec. 9, 1992

[51] Int. Cl.[5] ..... E21B 17/00

[52] U.S. Cl. ..... 166/65.1; 174/103

[58] Field of Search ..... 166/65.1, 68, 105, 385; 174/103

[56] References Cited

U.S. PATENT DOCUMENTS

| | | | |
|---|---|---|---|
| Re.32,225 | 8/1986 | Neuroth | 174/103 |
| 2,283,117 | 5/1942 | Arutunoff | 103/87 |
| 4,453,035 | 6/1984 | Neuroth | 174/103 |
| 4,453,036 | 6/1984 | Neuroth | 174/103 |
| 4,454,377 | 6/1984 | Neuroth | 174/103 |
| 4,454,378 | 6/1984 | Neuroth | 174/103 |
| 4,490,577 | 12/1984 | Neuroth | 174/103 |
| 4,532,374 | 7/1985 | Neuroth | 174/103 |
| 4,539,739 | 9/1985 | Himmelberger | 29/564.1 |
| 4,572,926 | 2/1986 | Neuroth | 174/103 |
| 4,609,416 | 9/1986 | Neuroth | 156/53 |
| 4,644,094 | 2/1987 | Hoffman | 174/47 |
| 4,675,474 | 6/1987 | Neuroth | 174/102 R |
| 4,681,169 | 7/1987 | Brookbank, III | 166/65.1 X |
| 4,707,568 | 11/1987 | Hoffman | 174/103 |
| 4,716,260 | 12/1987 | Hoffman | 174/102 R |
| 4,740,658 | 4/1988 | Hoffman | 174/103 |
| 4,743,711 | 5/1988 | Hoffman | 174/109 |
| 4,791,246 | 12/1988 | Neuroth | 174/102 R |
| 4,986,372 | 1/1991 | Ganssle | 174/106 SC |
| 5,051,103 | 9/1991 | Neuroth | 439/192 |
| 5,080,168 | 1/1992 | Wittrisch | 166/65.1 |
| 5,105,878 | 4/1992 | Forest et al. | 166/65.1 |

*Primary Examiner*—Thuy M. Bui

*Attorney, Agent, or Firm*—Jerry M. Presson; Mark S. Bicks

[57] ABSTRACT

A clamp attaches an electric submersible pump cable to a sucker rod to deploy and support the cable in an oil well. The clamp includes a core portion having a bore extending axially through the core portion for receiving the sucker rod. A pair of arms extends radially outwardly from the core portion. The arms grip the cable on the facing surfaces of the arms for engaging the cable in a space between the arms.

18 Claims, 1 Drawing Sheet

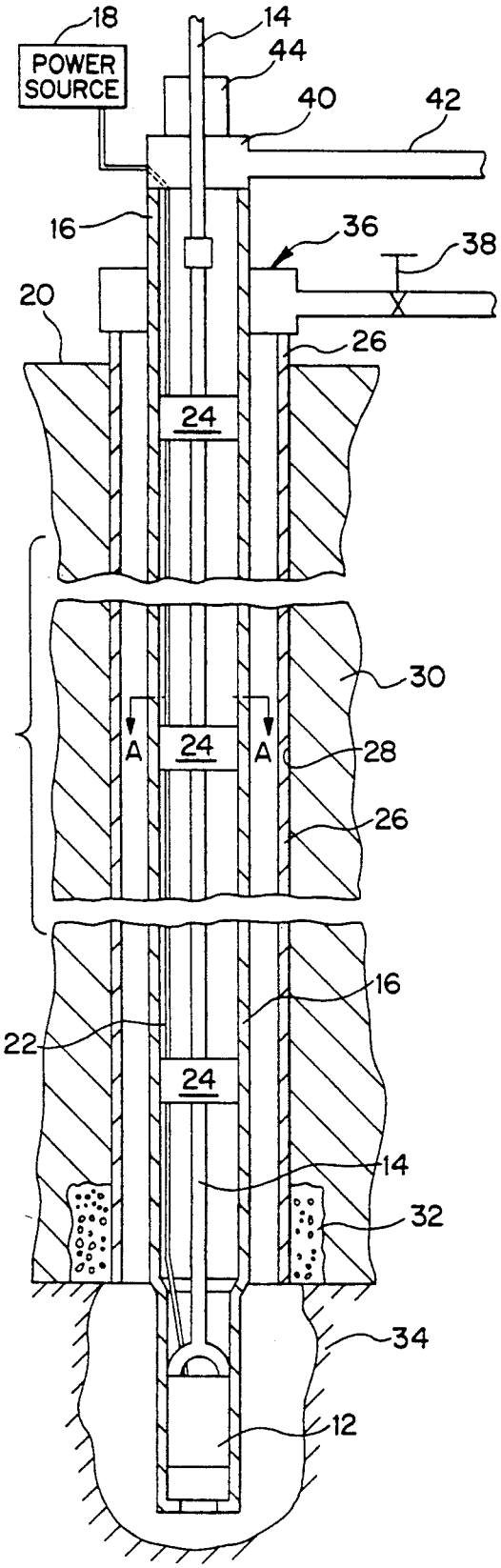
FIG. 1
FIG. 2
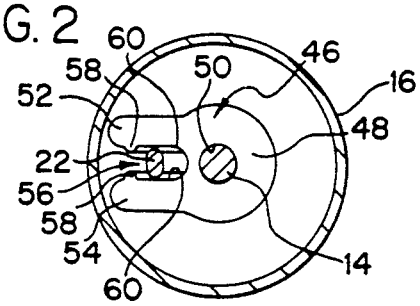
FIG. 3
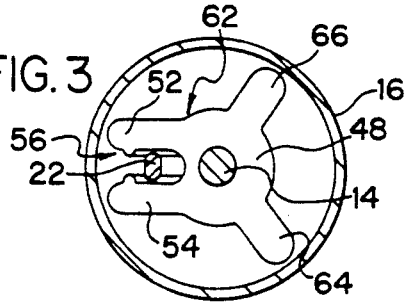
FIG. 4
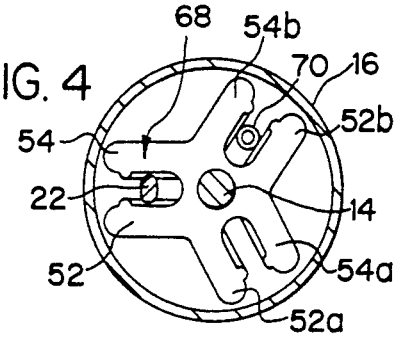
FIG. 5
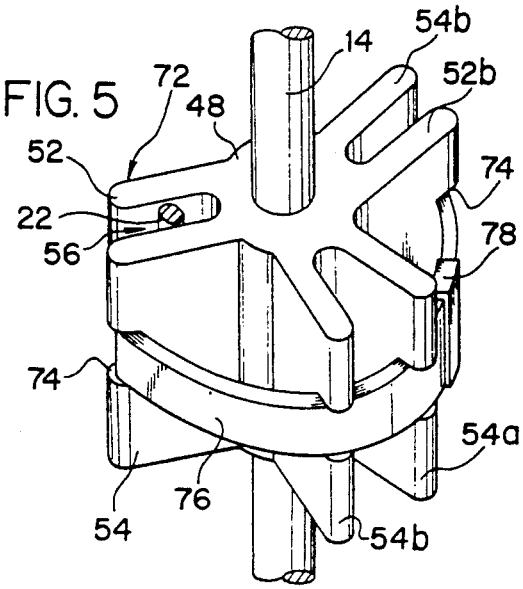

CLAMP FOR ATTACHING ELECTRIC SUBMERSIBLE PUMP CABLE TO SUCKER ROD

FIELD OF THE INVENTION

The present invention relates to a clamp for attaching the electric power cable for an electric submersible pump to an oil well sucker rod. More particularly, the present invention includes is a clamp with a core portion receiving the sucker rod in an axial bore through the core portion and with a pair of radially extending arms for engaging the cable.

BACKGROUND OF THE INVENTION

Electric submersible pumps for oil wells are powered by generators or other power sources located on the surface. The pump is located well below the surface at the bottom of the well. Conventional pumping systems attach the pump assembly on the bottom of eduction tubing through which the oil is pumped. The pump eduction tubing extends through a well casing. The electrical cable is secured by clamps 12 attaching the cable to the outside of the eduction tubing. A typical example of this system is disclosed in U.S. Pat. No. 2,283,177 to Arutunoff.

An improved system for deploying an electric submersible pump and its associated power cable within an oil well employs sucker rods to deploy, support and retrieve the electric submersible pump and the power cable for that pump. Using the sucker rods in this manner permits deployment using the existing hoisting equipment such that no special rig is required. The sucker rods can be relatively easily mass produced at relatively low cost. The use of the sucker rods permits both insertion and removal from the well. Positive seals are provided to avoid a sealing problem at the blow-out preventor. Additionally, use of the sucker rods enables the use of corrosion resistant materials in the well. Thus, using sucker rods to deploy the pump and its cable in the well, with the cable secured or otherwise attached to the sucker rods, is a desirable and effective deployment system.

SUMMARY OF THE INVENTION

An object of the present invention is to provide an apparatus for attaching an electric submersible pump cable to an oil well sucker rod which is relatively simple and inexpensive to manufacture.

Another object of the present invention is to provide an apparatus for attaching an electric submersible pump cable to an oil well sucker rod which is easy to deploy and retrieve, and securely retains the cable in place without interfering with flow through the well.

A further object of the present invention is to provide an electric pumping system for an oil well in which the electric submersible pump and the cable are deployed and supported by the sucker rods in an effective and efficient manner.

The foregoing objects are obtained by an apparatus for attaching a cable for an electric submersible pump to an oil well sucker rod. The apparatus includes a core portion, a bore extending axially through the core portion for receiving the sucker rod, and a pair of arms extending radially outwardly from the core portion. The arms have gripping means on facing surfaces of the arms for engaging the cable in a space between the arms.

The foregoing objects are also obtained by an electrical pumping system for an oil well comprising a generally cylindrical tubing extending into the well, a sucker rod extending axially through the tubing, and an electric submersible pump mounted on a lower end of the sucker rod. An electric cable is coupled to the pump and supplies electrical power to the pump. A plurality of cable clamps are mounted on and spaced axially along the sucker rod. Each clamp has a core portion with a bore extending axially through the core portion for receiving the sucker rod and a pair of arms. The arms extend radially outwardly from the respective core portion and have gripping means on facing surfaces of the arms for engaging the cable in a space between the arms of each clamp.

By forming the apparatus and electrical pumping system in this matter, the sucker rods can be effectively used for the deploying, supporting and retrieving the pump and the cable. The core portion attaches the apparatus to the sucker rods, while the arms attach the cable to the core portion. Conventional systems can be employed for deploying, supporting and retrieving the sucker rods, and thereby the pump and cable. Special rigging is not necessary for deploying the electric submersible pump and the power cable therefor. The arms securely retain the cable, while facilitating attachment of the cable to the apparatus or clamp and flow from the pump.

Other objects, advantages, and salient features of the present invention will become apparent from the following detailed description, which, taken in conjunction with the annexed drawings, discloses preferred embodiments of the invention.

BRIEF DESCRIPTION OF THE DRAWINGS

Referring to the drawings which form a part of this disclosure:

FIG. 1 is a side elevational view in section, graphically illustrating an electrical pumping system for an oil well according to the present invention;

FIG. 2 is a top plan view, in section, taken along line A—A of FIG. 1, showing a clamp according to a first embodiment of the present invention;

FIG. 3 is a top plan view in section, taken along line A—A of FIG. 1, showing a clamp according to a second embodiment of the present invention;

FIG. 4 is a top plan view in section, taken along line A—A of FIG. 1, illustrating a clamp according to a third embodiment of the present invention; and FIG. 5 is a partial, perspective view of a clamp according to a fourth embodiment of the present invention.

DETAILED DESCRIPTION OF THE INVENTION

Referring initially to FIG. 1, the electrical pumping system for an oil well according to the present invention includes an electric submersible pump 12 mounted on the lower end of a sucker rod or string of sucker rods 14 and within the interior of cylindrical tubing or tubing string 16. The pump is supplied with electrical power from a power source 18 located on the surface 20 by electrical cable 22. The cable extends along the inside of the tubing from the surface to pump 12 located at the bottom of the well, and is sealed and coupled to the pump in a conventional manner. The cable is deployed and supported within tubing 16 by a plurality of axially spaced clamps 24 which attach the cable to the sucker rod. The clamps are only graphically or symbolically illustrated in FIG. 1. The details of the various embodiments of the clamps are illustrated in FIGS. 2–5.

As illustrated in FIG. 1, the well includes a casing 26 mounted within a bore hole 28 formed in ground 30. The casing is secured in place by cement 32 located adjacent to the producing formation 34.

A casing vent 36 is mounted on the upper end of casing 26 and surrounds a portion of tubing 16 adjacent its upper end. The casing vent includes a control valve 38 as is conventional.

The upper end of tubing 16 is closed by a flow tee 40. A flow line 42 extends from flow tee 40. Fluid conveyed on by pump 12 flows up through tubing 16 into flow tee 40 and out flow line 42. The upper end of the sucker rod is mounted in a suitable sucker rod support 44. With the exception of clamps 24, the remaining oil well pumping structures are conventional, and thus, are not described in further detail.

Electrical cable 22 can be of any suitable conventional structure. Typical examples are disclosed in U.S. Pat. Nos. 4,780,574 to Neuroth, 4,743,711 to Hoffman, 4,740,658 to Hoffman et al, 4,716,260 to Hoffman et al, 4,707,568 to Hoffman et al, 4,532,374 to Neuroth, 4,454,378 to Neuroth, and 4,453,036 to Neuroth. The subject matter of each such patent is hereby incorporated by reference.

A first embodiment of the cable clamp is illustrated in FIG. 2. Clamp 46 comprises a core portion 48. Core portion 48 has an axially extending bore 50 which receives sucker rod 14. The sucker rod is securely fixed within the bore by being premolded on the sucker rod or otherwise attached such that the sucker rod and clamp are fixed against movement relative to each other. Alternatively, clamp 46 can be mounted on sucker rod 14 to permit the clamp to rotate about the sucker rod longitudinal axis, but be fixed against axial movement on the sucker rod. Such rotational movement will facilitate proper rotational orientation of the clamps within the casing such that the cable can extend straight up through tubing 16.

A pair of arms 52 and 54 extend radially outwardly from core portion 48, and define a space 56 between the arms for receiving cable 22. The arms extend radially outwardly to a location in close proximity to the inner surface of casing 16. By locating the distal ends of arms 52 and 54 in close proximity to the casing inner surface, the arms assist in guiding the sucker rod through the casing and provide insufficient space for the cable to be removed from space 56 while the clamp is located within casing 16.

Locating the distal ends of the arms in close proximity to the casing end surface also permits the cable to be automatically captured in space 56 by tubing 16 in the well. In this manner, the arrangement provides an automatic capture of the cable which would permit faster operation than attaching the cable with manually applied bands.

Retention of the cable within the clamp is enhanced by the provision of protrusions 58. Protrusions 58 extend toward each other from the facing surfaces of arms 52 and 54 adjacent the arm distal ends. The protrusions are of the size and shape that permit the cable to be snapped in place between the arms radially inwardly of the protrusions.

The arms can also be provided with a plurality of ridges 60 on the facing surfaces of the arms between protrusions 58 and core portion 48. The ridges are of a size and shape to interlock with the deformations in the cable armor. The interlocking of the ridges 60 with the cable armor restrains axial movement of the cable relative to the arms.

In the second embodiment of FIG. 3, clamp 62 is similar to clamp 46 in having core portion 48 and arms 52 and 54. The difference in clamp 62 is the addition of two guide webs 64 and 66 which extend radially outwardly from core portion 48 at locations angularly and circumferentially spaced from arms 52 and 54. Guide webs 64 and 66 are angularly spaced from each other and from space 56 between the arms by equal angles of approximately 120 degrees.

Guide webs 64 and 66 extend outwardly to distal ends located on a common circle with the distal ends of arms 52 and 54, which circle has a center on the longitudinal axis of sucker rod 14. Each of these distal ends is located in close proximity to the inner surface of tubing 16. In this manner, the distal ends of the arms and guide webs maintain the sucker rod along the center longitudinal axis of tubing 16.

Clamp 68 of FIG. 4 differs from clamp 62 of FIG. 3 by replacing guide web 64 and 66 with additional pairs of arms 52*a* and 54*a* and 52*b* and 54*b*. These additional arms can be used to support other structure extending through casing 16 such as conduit 70. The additional pairs of arms in clamp 68 also serve to guide the sucker rod along the center longitudinal axis of the tubing in the same manner as the guide webs of clamp 62. Since each pair of arms in clamp 68 is essentially identical they will not be described in detailed. The three pairs of arms pair are approximately equally angularly spaced at angles of approximately 120 degrees. The multiple pairs of arms also permit greater ease in aligning a particular space 56 between a pair of clamp arms with the cable.

The clamp 72 of FIG. 5 is a variation on the clamp 68 of FIG. 4 to provide a more secure locking of the cable to the clamp. In clamp 72, each arm has a recess 74 in the distal end edge extending along a portion of the axial length of each arm. Each recess 74 extends laterally into the respective arm. A locking band 76 extends around the core portion and the arms, and is received within recesses 74 to retain the cable in space 56. The recesses have a depth and width slightly greater than the width and depth of the locking band such that the band is spaced radially inwardly from the distal end edges of the arms. This radially inward spacing of the locking band from the arm distal end edges protects the locking band from being damaged by engaging the inner surface of tubing 16. The ends of the bands are retained in a locking member 78 of suitable design. The locking band forces and retains the cable between the arms. Although not illustrated in FIG. 5, arms 52, 54, 52*a*, 54*a*, 52*b* and 54*b* of clamp 72 can be provided with protrusions 58 and ridges 60.

Although each of the above embodiments provide a secure connection of the cable, they also permit adequate space to allow easy passage of production fluids through tubing 16.

While various embodiments have been chosen to illustrate the invention, it will be understood by those skilled in the art that various changes and modifications can be made therein without departing from the scope of the invention as defined in the appended claims.

What is claimed is:

1. An apparatus for attaching a cable for an electric submersible pump to an oil well sucker rod, comprising:

a core portion;

a bore extending axially through said core portion for receiving the sucker rod; and a pair of arms extending radially outwardly from said core portion, said arms having gripping means on facing surfaces of said arms for engaging the cable in a space between said arms.

2. An apparatus according to claim 1 wherein said gripping means comprise protrusions extending from said arms into said space at locations spaced from said core portion.

3. An apparatus according to claim 1 wherein said gripping means comprises a plurality of ridges for interlocking with armor on the cable to restrain axial movement of the cable relative to said arms.

4. An apparatus according to claim 1 wherein a plurality of guide webs extend radially from said core portion at locations angularly spaced from said arms.

5. An apparatus according to claim 4 wherein two guide webs are provided and are each spaced at approximately equal angles from said arms.

6. An apparatus according to claim 4 wherein said arms and said guide webs have distal ends located on a single circle.

7. An apparatus according to claim 1 wherein a second pair of arms extend radially outwardly from said core portion, said second pair of arms having gripping means on facing surfaces of said second pair of arms for engaging a conduit in a space between said second pair of arms.

8. An apparatus according to claim 7 wherein a third pair of arms extend radially outwardly from said core portion, said third pair of arms having gripping means on facing surfaces of said third pair of arms for engaging a conduit in a space between said third pair of arms.

9. An apparatus according to claim 1 wherein said arms have distal end edges extending along axial lengths of said arms, each of said edges having a recess extending laterally into the respective arm; and a locking band extends around said core portion and said arms, and is received in said recesses to retain the cable in said space.

10. An electrical pumping system for an oil well, comprising:

a generally cylindrical tubing extending into the well;

a sucker rod extending axially through said tubing;

an electric submersible pump mounted on a lower end of said sucker rod;

an electric cable, coupled to said pump, for supplying electrical power to said pump; and a plurality of cable clamps mounted on and spaced axially along said sucker rod, each of said clamps having a core portion with a bore extending axially through said core portion for receiving said sucker rod and a pair of arms extending radially outwardly from said core portion, said arms having gripping means on facing surfaces of said arms for engaging said cable in a space between said arms of each said clamp.

11. An electrical pumping system according to claim 10 wherein said gripping means comprise protrusions extending from said arms into said space at locations spaced from said core portions.

12. An electrical pumping system according to claim 10 wherein each said gripping means comprises a plurality of ridges for interlocking with armor on said cable to restrain axial movement of said cable relative to said arms.

13. An electrical pumping system according to claim 10 wherein a plurality of guide webs extend radially from each said core portion at locations angularly spaced from said arms thereof.

14. An electrical pumping system according to claim 13 wherein two guide webs are provided on each said clamp and are spaced at approximately equal angles from said arms thereof.

15. An electrical pumping system according to claim 13 wherein said arms and said guide webs have distal ends located on a single right circular cylinder.

16. An electrical pumping system according to claim 10 wherein second pairs of arms extend radially outwardly from said core portions, said second pairs of arms having griping means on facing surfaces of said second pairs of arms for engaging a conduit in spaces between said second pair of arms.

17. An electrical pumping system according claim 16 wherein third pairs of arms extend radially outwardly from said core portions, said third pairs of arms having gripping means on facing surfaces of said third pairs of arms for engaging a conduit in spaces between said third pairs of arms.

18. An electrical pumping system according to claim 10 wherein said arms have distal end edges extending along axial lengths of said arms, each of said edges having a recess extending laterally into the respective arm; and a locking band extends around each said core portion and said arms thereof, and is received in the respective recesses to retain the cable in the respective space.

* * * * *